US005485713A

United States Patent [19]

Moncrief

[11] Patent Number: 5,485,713

[45] Date of Patent: Jan. 23, 1996

[54] METHOD AND APPARATUS FOR INSERTING PARTITIONS INTO ARTICLE GROUPS

[75] Inventor: Frank Moncrief, Acworth, Ga.

[73] Assignee: Riverwood International Corporation, Atlanta, Ga.

[21] Appl. No.: 274,929

[22] Filed: Jul. 14, 1994

[51] Int. Cl.[6] ..... B65B 35/44; B65B 61/00

[52] U.S. Cl. ..... 53/445; 53/157; 53/263; 53/448; 53/474

[58] Field of Search ..... 53/448, 445, 474, 53/443, 157, 156, 566, 263

[56] References Cited

U.S. PATENT DOCUMENTS

| | | | |
|---|---|---|---|
| 2,247,695 | 7/1941 | Papendick | 53/448 X |
| 3,719,018 | 3/1973 | Focke et al. | 53/445 |
| 3,760,557 | 9/1973 | McIntyre | 53/157 |
| 4,642,967 | 2/1987 | Culpepper | 53/580 X |
| 4,962,625 | 10/1990 | Johnson, Jr. et al. | 53/263 X |

*Primary Examiner*—James F. Coan

[57] ABSTRACT

A method and apparatus for inserting partitions into a group of articles is disclosed. The method includes combining articles, such as beverage containers, to form an article group of predetermined configuration, including longitudinal rows of articles. The article group is conveyed toward a divider deposed in the path of travel. The divider, which includes an angled end portion that acts as a cam, separates the article subgroup into article subgroups. Once the article subgroups are transversely separated to a predetermined extent, a partition inserter places a partition between the article subgroups. The two subgroups are then recombined to affix the partition between adjacent articles. The recombined article group, including a partition, is then moved through the packaging machine to the next process step or simultaneously inserted into cartons.

29 Claims, 5 Drawing Sheets

METHOD AND APPARATUS FOR INSERTING PARTITIONS INTO ARTICLE GROUPS

FIELD OF THE INVENTION

This invention generally relates to packaging machines and to the process of packaging articles, such as beverage containers. More specifically, the present invention relates to a method and apparatus for inserting partitions into article groups. The insertion of partitions between the beverage containers is considered a distinct process step in the multistage packaging operation.

BACKGROUND OF THE INVENTION

Automated machinery for packaging articles in a continuous, multistage packaging operation are widely known. Articles which are subject to being packaged using this type of machinery include beverage containers, such as cans and glass and plastic bottles. Although such beverage containers are especially amenable to being packaged in such an operation, many other types of consumer goods also can be packaged using these automated machines. Packaging machines ordinarily include devices which perform a variety of distinct operations or steps in succession and in a continuous, high speed manner. It is not unusual for beverage container packaging machines to package over 1,000 containers per minute in uninterrupted flow. The distinct process steps of known packaging machines include forming a group of articles of a predetermined configuration and delivering the article group into an open carton. The formation of the article groups normally include conveying articles along discrete, parallel lanes disposed at an angle to a selection area, and selecting a predetermined number of articles from the lane by a selector wedge or metering bar. The selectors can be carried by a movable conveyor, and select the predetermined number of articles, effect arrangement of the articles in the predetermined configuration, and convey the articles to the next process step, for example, for the delivery of the articles into the carton. U.S. Pat. No. 3,778,959 to Langen et al. illustrates such a selection apparatus and method. Similarly, U.S. Pat. No. 4,887,414 to Arena and U.S. Pat. No. 5,241,806 to Ziegler et al. also disclose methods and apparatuses for forming preconfigured bottle groups in this fashion. Each of these references also teaches methods and apparatuses for loading the articles into open cartons. Therefore, the steps of forming article groups of predetermined configuration, conveying the article groups along a path of travel on a moving conveyor, and delivering the formed article group into a carton generally are well known.

The packaging operations can include the process step of inserting separate partitions, or article separators, within an article group prior to that article group's being inserted into a carton or carrier. This process step typically is after the article group is formed, but prior to inserting the article group into the carton. In the case of beverage containers, such as bottles, partitions comprised of paperboard panels have been used to separate juxtaposed bottles, primarily to keep the bottles from impacting on one another during shipment. This was especially necessary in the past, when the cartons, typically paperboard carriers, holding the bottle group were not designed to effectively stabilize the bottles, allowing the bottles to shift and move during shipment and other handling operations. Over the years, carton designs improved, providing for less bottle movement during shipping, using other features which were intended to decrease the likelihood of bottle breakage. These features included various types and locations of tabs extending inwardly from the carton side panels to assist in stabilizing the bottles.

Many other types of cartons, however, neither provide internal stabilizing mechanisms nor control article movement sufficiently to avoid the need for separate partitions, those formed separately from the carton, to be placed within the article group and between the bottles. Additionally, in other instances it is desirable to have such separate partitions even when the container is designed to control article movement to some extent. Some bottlers and insurance carriers, for example, often require that breakable articles be separated by partitions, for the shipment of those articles to be within the terms of contract.

Adding to the need to position separate partitions within such containers in some cases is the recent commercialization of processes for manufacturing beverage containers of lighter weight glass. The commercialization of these lighter weight bottles has presented the packaging industry and the packaging machine manufacturing industry with the renewed problem of container breakage, which many believed had been successfully addressed by prior developments in carton designs. In other words, these developments in bottle designs, together with commercial shipping regulations and contracts, have again focused the relevant industries' attentions on the need to separate breakable articles with partitions which are formed separately from the carton.

As a result of separate partitions being utilized to some degree in the prior art, it has become known that as a packaging process step, it is desirable to separate the articles from contact with one another prior to insertion of the partition into an article group. This is necessitated for many reasons, including the need to allow the partition to be fully and readily inserted between adjacent bottles to ensure that the partition is properly inserted before the next process step, which typically is the loading of the article group into a carton, and to prevent the insertion of the partition from impacting, interfering with or tearing article labels.

Prior art machines commonly carried out the process step of inserting separate partitions into, for example, a bottle group, by first separating the bottles within the group using separating and drive lugs carried by chain conveyors. In this system, two rows of bottles are fed onto an immovable table, or deadplate. The bottles then are separately engaged at their lower edges by horizontally extending lugs mounted to drive chains, which are positioned along either side of the deadplate. The lugs are adjacent to each bottle, and serve not only to push the bottle along the deadplate, but also to separate the bottles from one another in the longitudinal direction of the conveyor. A bottle divider which is centeredly disposed and longitudinally aligned with the deadplate, extending about an inch above the surface of the deadplate, separates the adjacent bottles from one another, transversely. In these prior art machines, therefore, two rows of bottles, separated from one another longitudinally and transversely, were conveyed below a partition inserter, which inserted a separate partition between groups of bottles, to define and separate, for example, six bottles for a six pack configuration. Once the partition was inserted in these article groups, the bottles then were delivered to a station of the packaging machine which either grouped the bottles more closely together in preparation for the delivery of the entire bottle group to a carton, or performed these latter steps of grouping and delivery simultaneously.

Although this type of prior art machine performed satisfactorily, it necessarily included the drawbacks of complexity caused by the requirement of the lugs and the chain conveyors used along with the deadplate. Further, the bottles being conveyed in an upright position by this conveyor were unstable because of the lug and centrally disposed divider positions, which necessarily had to be very low to allow the partition to drop into its proper position. Additionally, while article groups of various configurations were possible, this machine typically would permit the formation of a six pack configuration, unless the machine included two separate conveyors of this type arranged on either side of the packaging machine to allow two, six bottle article groups to be loaded into either side of a carton disposed between the bottle groups. While such machines performed satisfactorily within the limitations specified, they tended to be large, and consequently required extensive floor space because of the separate conveyor design. Further, these prior machines mostly were designed to process and to package only one type of article, having a specific size and height.

SUMMARY OF THE INVENTION

The present invention comprises a method and apparatus for inserting partitions into article groups. The invention ideally is suited for packaging machines which utilize a single article infeed disposed along one side of the machine, although it also could be used on multi-in-feed packaging machines. The apparatus includes a moving conveyor, such as a flight conveyor, which carries configured groups of articles along a longitudinal path of travel. The invention optimally is intended for the insertion of partitions into article groups including at least two rows of articles aligned along the longitudinal path of travel.

In the case of an article group comprised of two rows of articles, the article group is conveyed towards a first article divider disposed above the conveyor. The article divider preferably comprises an elongate guide with an angled edge along one side to define a tapered end portion extending in the upstream direction, that is opposite to the direction of travel of the article groups. At approximately this same position along the conveyor, a conveyor side rail angles outwardly to increase the working conveyor width. The article group is conveyed towards the divider until the divider begins to extend between two longitudinal rows of articles within the article group. As the conveyor continues to convey the article group downstream, the divider begins to divide the article group into first and second subgroups, by separating one row of articles from the other row by a camming action. As the two article subgroups continue to be conveyed downstream, the divider separates entirely the article subgroups. The article subgroups, therefore, are divided transversely from one another a distance equal to the maximum width of the divider, which is approximately equal to the transverse distance which the conveyor side rail angles outwardly. This width is predetermined in order to move the article subgroups away from one another a sufficient distance to allow a partition to be freely inserted between the first article subgroup and the second article subgroup, so that the tangent or contact points between juxtaposed articles within any row do not interfere with the insertion of the partition.

At this point, the separated article subgroups move beneath a partition inserter, which inserts a partition between adjacent articles. One article subgroup is then moved back toward the other article subgroup by contact with an angled side rail, guide or second cam, so that the bottles within the recombined article group are placed in contact with the partition and in closer relationship with one another. In the case of an article group comprised of only two rows of articles, the recombined article group with a partition is now ready to be inserted into a carton or carrier. Optionally, the articles can be recombined during the actual process step of inserting the articles into the carton.

In cases in which an article group comprised of more than two rows of articles is being packaged, a second guide, substantially identical to the first guide in design, is positioned downstream of the first guide and downstream of the insertion point of the first partition, above the conveyor. The orientation of the second guide is similar to that of the first guide, with the tapered end portion of the second guide extending upstream, but aligned to extend between the second and third article rows. The conveyor successively moves the article subgroups having a partition between the first and second rows, towards the second guide. The articles contact the tapered end portion of the second guide, between the second and third rows of articles, simultaneously to recombine the first and second article rows while separating the second and third article rows sufficiently to allow a second partition to be inserted between the second and third article rows. The second and third article rows are then recombined by directing, for example, the third article row, against a rail or cam disposed within the path of travel to move the third article row back towards the first and second article rows, and therefore into a single article group.

The above methods and apparatuses can be duplicated when four or more rows of articles comprise the article group configuration. Of primary importance is the dividing of a row of articles from the article group sufficiently to allow a partition to be inserted between adjacent article rows without enough interference from contact with the articles to prevent the partition from being inserted. The present invention includes numerous embodiments which can allow an article subgroup to be divided while another article subgroup simultaneously is being recombined. Otherwise, all article subgroups can be separated, with partitions thereafter being inserted, and then the subgroups of articles being recombined simultaneously either prior to or during the insertion of the articles into a container or carton.

It is an object of the present invention, therefore, to provide an apparatus for inserting partitions into article groups, which eliminates the necessity of using maintenance intensive, repetitious moving elements to separate and recombine article groups. It is another object of the present invention to provide a method and apparatus for inserting partitions into article groups, which readily can be used with high speed, multiconfigurable packaging machines. Other objects, features and advantages of the present invention will become apparent upon reading the following specification in conjunction with the accompanying drawing figures.

DETAILED DESCRIPTION OF THE PREFERRED EMBODIMENTS

Figures 1, 1A:
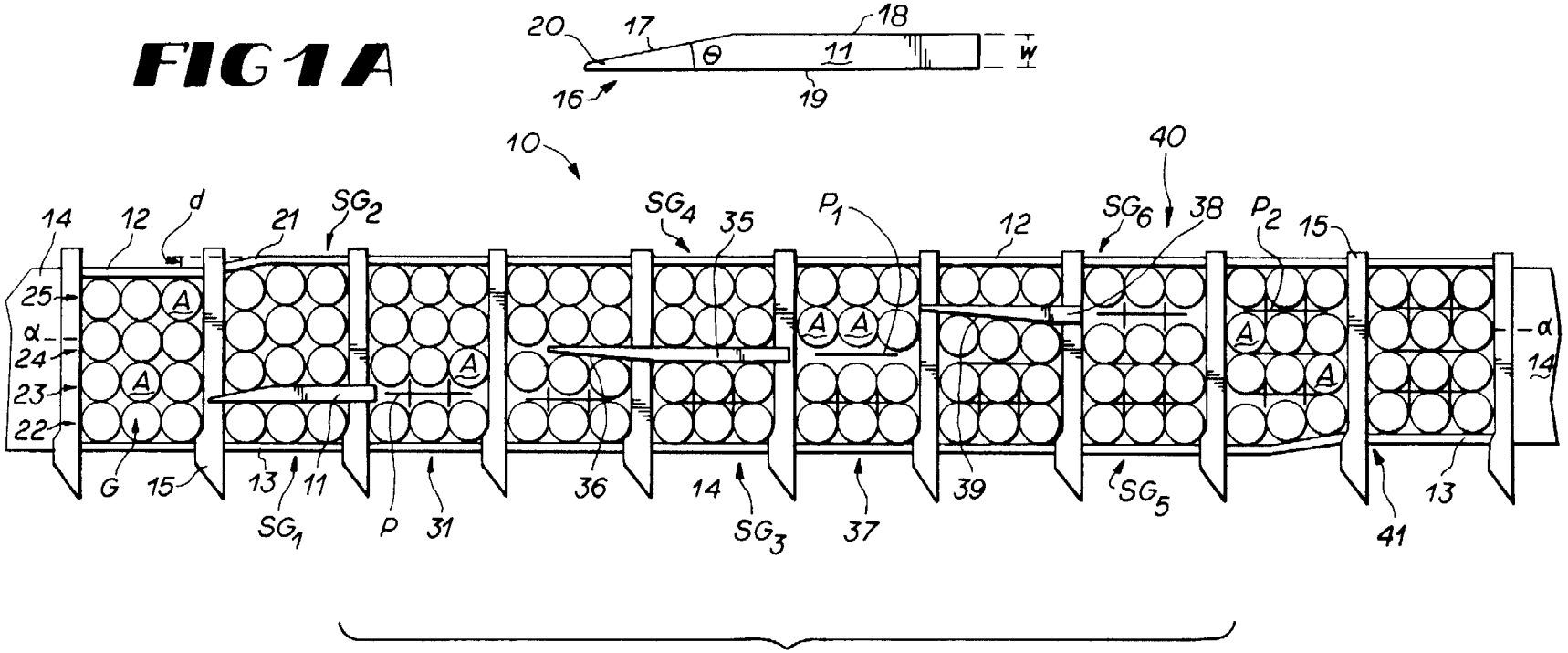
FIG. 1 is a fragmentary, schematic plan view of one embodiment of the present invention.
FIG. 1A is a schematic plan view of a divider shown in FIG. 1.

FIG. 1 shows a partition insertion assembly 10 of a packaging machine, such as a beverage container packaging machine. The partition insertion assembly 10 is positioned downstream of the article selection and grouping assemblies and upstream of the article transfer assembly in the packaging operation, for example, as discussed above with respect to the prior U.S. patents. Assembly 10 includes upstanding, elongate side rails 12 and 13 disposed to either side of a moving conveyor 14. Conveyor 14 preferably is a continuous moving surface conveyor or belt-type conveyor well known in the art, which defines a path of travel along its longitudinal axis . As shown in FIG. 1, conveyor 14 moves in a direction from left to right. Selector wedges 15 are supported by conveyor 14 and are positioned above the upper surface of the conveyor. The selector wedges or selectors comprise means for defining article groups, and are elongate members spaced from one another and arranged extending transversely with respect to the longitudinal axis of the conveyor. Although the means for defining article groups are shown in FIG. 1 as selector wedges or flights 15, the function of the wedges at this point in the packaging operation is simply to define successive article groups from one another along the conveyor. The selector wedges, therefore, at this point in the packaging operation, do not need to be selector type flights with an angled or wedge shaped end portion designed to perform the picking or selection function described in detail in the above-referenced U.S. patents. During the process of inserting the partitions, members 15 need only define successive article groups along a moving surface-type conveyor.

Since the partition insertion assembly 10 is downstream of the article selection and grouping assembly, but upstream of the article transfer assembly where the articles are transferred to or inserted into a carton or carrier, when the articles reach the partition insertion assembly, the articles already have been arranged into an article group of predetermined configuration. In FIG. 1, articles A have been grouped into a 12 pack configuration with four rows extending along the longitudinal axis $\alpha$, and three columns extending transverse or normal to the longitudinal axis. This 12 pack article group is shown for illustration only. The present invention is not limited to such an article group in configuration or number, but is readily used with any article group having articles arranged in two or more rows extending along the longitudinal axis of the conveyor 14. Although FIG. 1 shows a schematic, plan view of bottles arranged on assembly 10, the articles A could comprise practically any type of article capable of being herded or formed into an article group and inserted into a carrier. The present invention, however, is ideally suited to package containers, such as bottles or cans, which are supported on the upper surface of the conveyor and extend upwardly from the conveyor's upper surface.

A divider 11, or means for moving the article in a transverse direction, is disposed above the conveyor 14 and above selector wedges 15. This divider or guide 11 is immovable in its operating position, and is supported in its position above conveyor 14 by any suitable means, so as not to interfere with the conveyor movement or with the movement of the flights 15 along the path of travel. The dividers 11 preferably are mounted so that their respective positions can be modified or changed if, for example, articles of different diameters are packaged on different process runs. Any means known in the art for immovably supporting dividers 11 in the positions shown in the drawings, while allowing those positions to be selectively modified, is acceptable, provided that it does not interfere with the process. The divider 11 is elongate and preferably square or rectangular in cross section at its downstream end. At its upstream end, divider 11 includes tapered end portion 16. The tapered end portion includes an angled side edge 17 which extends rearwardly as shown in FIG. 1A to intersect straight edge 18. Parallel to and opposing straight edge 18 is straight edge 19, which joins edge 17 at the tip or point 20. The angled edge 17 extends away from tip 20, at an angle 0 with straight edge 19 to form the wedge shape portion 16. It is thus seen that the divider 11 includes a substantially pointed end with one edge being entirely straight and another edge having a straight portion and an angled portion. It is important that the tapered end 16 of the divider extend upstream and be positioned to extend between adjacent article rows. As to the angle 0 or the degree of slope of edge portion 17 and the length of edge 17, that angle and length need only be sufficient to move the articles gradually, transversely with respect to the longitudinal path of travel, without interfering with smooth article flow along with the conveyor. The maximum width W of divider 16 needs to be sufficient to accomplish the unencumbered partition insertion process step, discussed below.

At substantially the same position that angled edge 17 extends downstream from tip 20, side rail 12 also angles outwardly. The distance d which rail 12 angles outwardly at angled rail portion 21 is substantially equal to the width W of the divider. The outward angle of rail 12 increases the working width of conveyor 14, and therefore allows respective subgroups of articles to be consecutively moved away from the article group or another article subgroup in the transverse direction a distance equal to d or W.

In operation, the conveyor 14 continuously moves from an upstream position to a downstream position, or from left to right as shown in FIG. 1, moving selector wedges 15 and the configured groups of articles A downstream. A group of twelve articles shown in FIG. 1 arranged in four rows and three columns is labeled G. The articles are moved continuously toward divider 11 until the tip 20 of divider 11 projects between first article row 22 and second article row 23. The conveyor continues to move the article groups downstream, which causes the articles in second article row 23 to impact against angled edge 17 of the first divider 11. The continued force of the articles in the second article row against angled edge 17 moves the second article row 23 transversely with respect to the longitudinal axis $\alpha$ and away from first article row 22. Although the articles obviously also continue to move longitudinally along with the conveyor's continuous movement, the transverse component of the article movement is of primary importance to the present invention. The embodiment shown in FIG. 1 is that of a 12 pack configuration, so two additional article rows, third article row 24 and fourth article row 25, are also moved transversely away from first article row 22, a distance equal to width W. Side rail 12 angles outwardly at this approximate position, as shown in FIG. 1, a distance d to permit the third and fourth article rows, along with the second article row, to move transversely away from the first article row. The conveyor 14 continues to move the articles downstream until the second article row is adjacent to edge 18. At this position, the first and second article rows are transversely spaced from one another a distance equal to W, which has been predetermined to be a sufficient distance apart so as to allow for the unobstructed insertion of a partition. The moving or dividing of the articles in this fashion can be considered creating article subgroups by dividing the original article group G, consisting of four rows, 22, 23, 24 and 25, into two subgroups. The first subgroup $SG_1$ comprises the articles in first row 22, and the second subgroup $SG_2$ comprises the articles in rows 23, 24 and 25.

Figure 2:
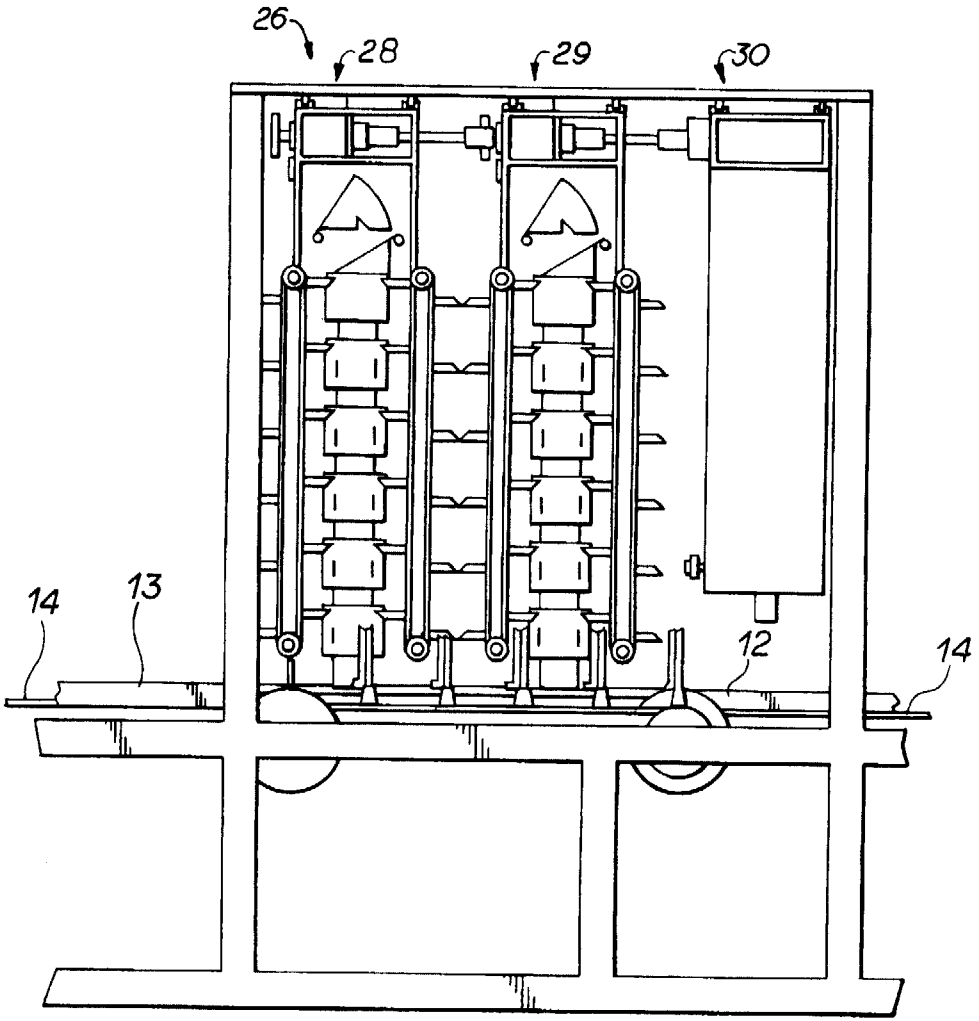
FIG. 2 is a fragmentary, schematic elevational view of the partition inserter of the present invention.

As the conveyor continues to move the article subgroups downstream, the articles are moved beneath a partition inserter 26, which is part of partition insertion assembly 10. This inserter is spaced above conveyor 14, flights 15 and divider 11, and held above these elements by the frame of packaging machine, as schematically shown in FIG. 2. The position of the partition inserter 26 above the conveyor shown in FIG. 1 is denoted generally as numeral 27.

Figure 1B:
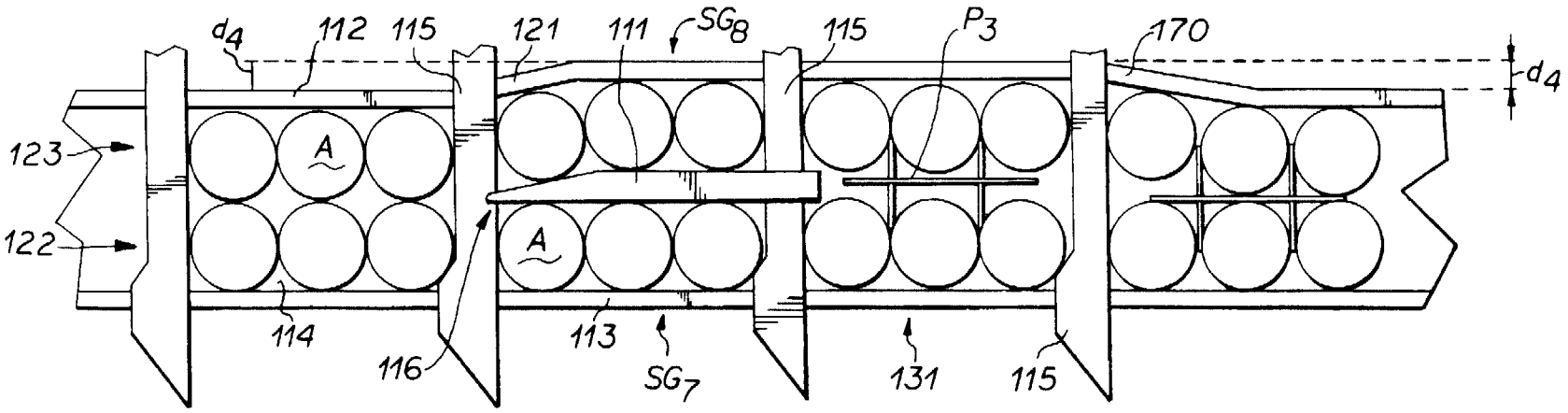
FIG. 1B is a fragmentary, schematic plan view of another embodiment of the present invention.
Figure 1C:
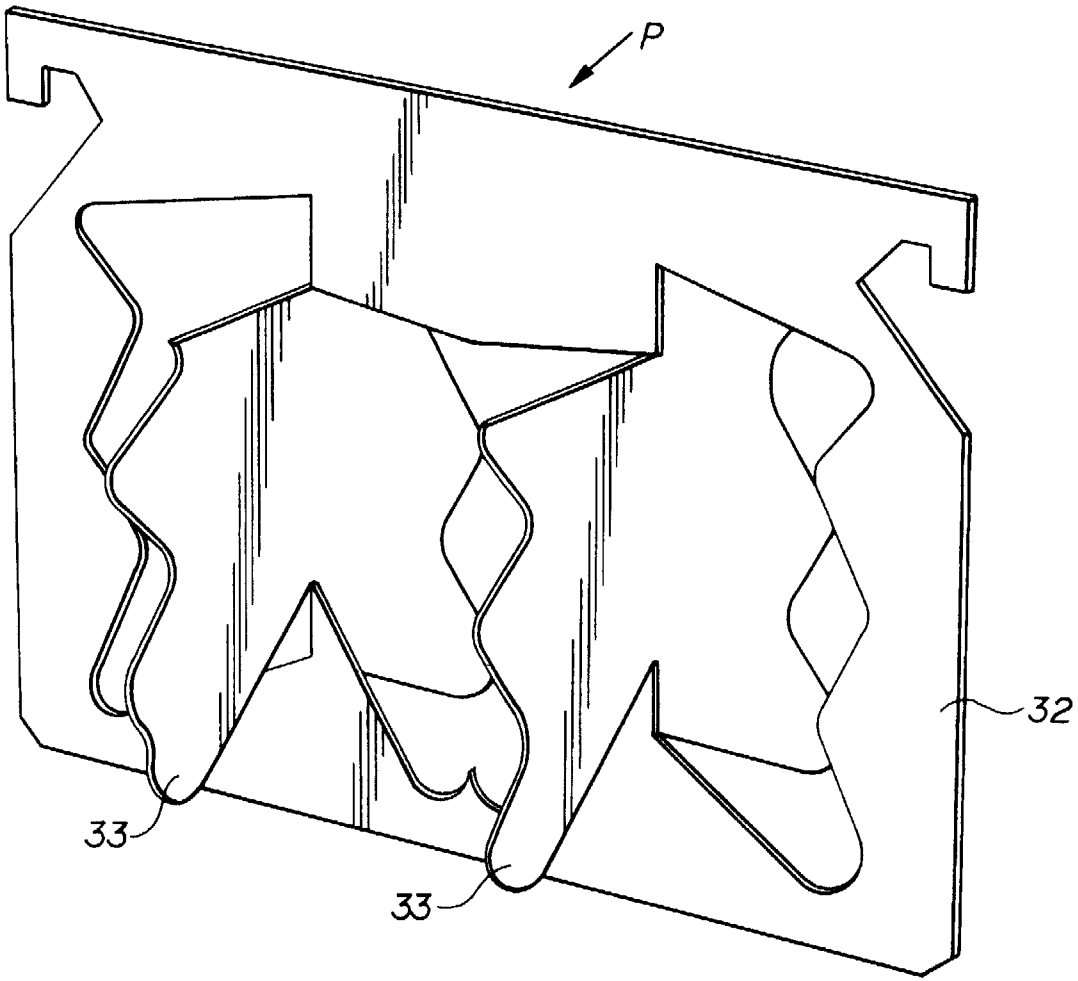
FIG. 1C is a perspective view of a partition.

FIG. 2 schematically illustrates the partition inserter capable of inserting partitions into a 12 pack article configuration. As such, the partition inserter includes three partition inserting stations, the first station denoted by numeral 28, the second station 29, and the third station 30. Known partition inserter assemblies in the packaging industry are suitable for use in the present invention. The first partition inserting station 28 is positioned over conveyor 14 generally at position 31. The conveyor moves the articles below the first partition inserting station at area 31. At this area, the first article row 22 and second article row 23 are separated sufficiently to allow a partition P to be inserted between the first and second article rows without interference from the articles in article rows 22 and 23. As shown in FIG. 1C, the partition P is elongate, having body portion 32 and wings 33 extending transversely on either side of body portion 32. Paperboard partitions of this general shape, that is, an elongate body portion with transversely extending wings, are well known in the packaging industry.

Figure 3:
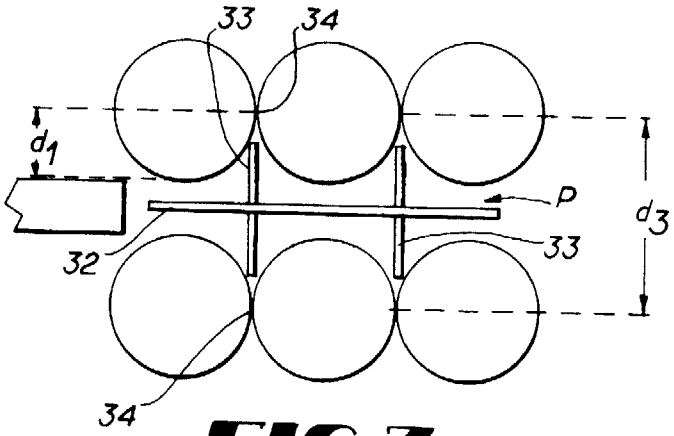
FIG. 3 is a schematic plan view of a separated article group comprising two article subgroups, with a partition.

At this point in the partition insertion process, the articles in the first and second article rows have been separated sufficiently so that as a partition P is downwardly inserted between article rows 22 and 23 as shown in FIG. 3, the wings of the partition do not contact the articles to an extent that would prevent the partition from being fully inserted between the article rows. That is, the first and second article rows have been moved away from each other to such an extent so that the tangent points 34 between the articles, which are the points where the sides of the articles touch, are not close enough together in a respective row to prevent the partition from being fully inserted. The partition is considered fully inserted when the lowermost edge of the body portion of the partition lies against the conveyor 14 and the wings 33 of the partition will extend outwardly a sufficient extent to keep adjacent articles in each respective row from touching one another, when the article groups are recombined.

Such packaging machines as the one described typically include continuous moving flight conveyors. Therefore, the insertion of a partition must be timed with the separated article subgroup's movement beneath the partition inserter.

Figure 4:
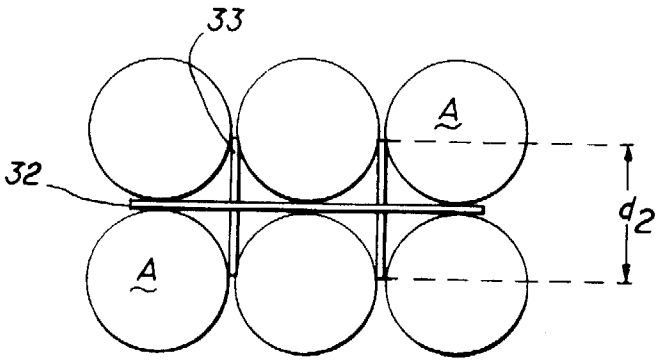
FIG. 4 is a schematic plan view of a recombined article group, with a partition.

The maximum width W of the divider must be sufficient to separate adjacent article rows sufficiently so that a partition can be freely inserted, as described above. The wings 33 of the partition must extend outwardly from the partition, as shown in FIGS. 3 and 4, a distance equal to the radius of the article or the distance from the outer side of the article to the tangent point 34, which distance is denoted $d_1$. The total distance from the outer edge of one wing to the outer edge of another, aligned wing, as shown in FIG. 4, is denoted $d_2$. This length or distance $d_2$ is the minimum total distance two aligned wings must extend in order to separate adjacent bottles in each longitudinal row, as shown in FIG. 4. Therefore, the opposing tangent points 34 of the bottles of the respective longitudinal rows, for example rows 22 and 23, must be separated from one another a distance $d_3$, which is slightly greater than $d_2$. The distance $d_3$ must be sufficient to allow the partition to be downwardly inserted between adjacent article rows without interference from the bottles of the article subgroups. Distance d, therefore, need only be just sufficient to allow for unimpeded partition insertion. As long as the values of the above variables are considered, width W is easily determined by several means, including by the following formula: $W=d-2d_1$.

While width W must be sufficient to separate the articles enough to prevent the unimpeded insertion of a partition, the articles, however, should not be separated so far as to preclude the sides or circumferences of juxtaposed articles in respective article rows from acting as loose guides for the wings. Ordinarily, the wings of such partitions are scored sections which fold outwardly from the partition body, and which tend to fold back on occasion toward the partition body. If the article rows are laterally moved away from each other too large of an extent, the wings may be able to spring back, as is their natural tendency, towards the partition body.

Once the partition has been properly inserted between adjacent article rows, the article rows are then recombined, or moved back together substantially adjacent to one another so that all bottles in these article rows contact the partition and hold the partition in place between the bottles. FIG. 1 shows the recombining of the articles in the first and second article rows while simultaneously separating the second and third article rows from one another. Divider 35 is positioned downstream from divider 11 and downstream from the position 31 of the first partition insertion station 28. The divider 35 is substantially identical in structure and function to divider 11, with the exception that the angled edge 36 is along the edge of divider 35 most closely adjacent to side rail 13, whereas the angled edge 17 of divider 11 is along the edge of divider 11 most closely adjacent to side rail 12. The placement of angled edge 36 on the side of divider 35 adjacent side rail 13 acts as a cam to direct the bottles in second article row 23 toward first article row 22 and side rail 13 as shown in FIG. 1, to accomplish the recombining of the articles in the first and second article rows.

As the articles in second article row 23 are moved toward side rail 13 by the action of the conveyor moving the articles downstream against angled edge 36, the articles in the second article row 23 also are simultaneously thereby moved transversely or laterally, away from the articles in third article row 24. Thus, the articles in second article row 23 and third article row 24 are moved away from each other a distance equal to the width W, of second divider 35. This action effectively creates two new article subgroups, $SG_3$ comprising the articles in rows 22 and 23 and $SG_4$ comprising the articles in rows 24 and 25. The conveyor continues to move these articles in the second and third article rows downstream past divider 35 and beneath second partition inserting station 29 at position 37, where partition P is inserted between the second and third article rows. If a winged partition, as shown in FIG. 3 is utilized, the width W of divider 35 is determined identically as the width W of divider 11, as described above. The partition P, however, optionally can be in the form of a rectangular card, without wings, since the other partitions in the article group have wings and so effectively prevent the contact of adjacent articles along the longitudinal axes of the respective rows of articles. If a rectangular partition without wings is used as the central partition, the width $W_1$ of divider 35 need only be sufficient to divide subgroups $SG_3$ and $SG_4$ enough to allow the partition card to be inserted between rows 23 and 24.

The conveyor 14 continues to move the article subgroups away from divider 35 and toward divider 38, which is positioned to extend between article rows 24 and 25. Divider 38 is substantially identical in structure and function to divider 35, with angled edge portion 39 along the upstream edge of divider 38 closest to rail 13. As conveyor 14 continues to move article subgroups $SG_3$ and $SG_4$ downstream, the articles in article rows 24 and 25 also are moved downstream so that the tapered end portion of divider 38 extends between rows 24 and 25. The continued movement of the conveyor downstream forces the articles in article row 24 against the angled edge 39 of divider 38, separating article rows 24 and 25, and creating two new article subgroups, $SG_5$ and $SG_6$. Subgroup $SG_5$ comprises the articles in rows 22, 23 and 24, while subgroup $SG_6$ comprises the articles in row 25. Since a winged partition $P_2$ should be used for insertion between article rows 24 and 25, the width of divider 38 is determined identically as described above with respect to the determination of the width of divider 11. The separating of article rows 24 and 25 by divider 38 moves the articles in row 24 toward rail 13, moving article row 24 adjacent to article row 23, so that the partition $P_1$ is contacted and held in position by the articles in rows 23 and 24. As the conveyor continues to move the article subgroups downstream, subgroup $SG_5$ is transversely moved away from subgroup $SG_6$ by guide 38 sufficiently to allow for the insertion of partition $P_2$. At this position 40, station 30 inserts the partition $P_2$, which is identical to partition P, between the third and fourth article rows.

Downstream of position 40, rail 13 includes angled section 41 which angles inwardly a distance equal to d and W as shown in FIG. 1. The continuous downstream conveyor movement of the articles causes the articles in the first article row to impact the angled portion 41 of side rail 13, thereby moving articles in article subgroup $SG_5$ toward side rail 12, and also toward article subgroup $SG_6$. In this manner, all articles in the entire article group, which comprises article rows 22, 23, 24 and 25, are recombined to form an article group containing partitions P, $P_1$ and $P_2$ with the articles in rows 24 and 25 contacting partition $P_2$ and holding it into proper position. The conveyor continues to move the article groups downstream to a position where the totally recombined article group, including partitions, is transferred from the conveyor and into a carton or carrier in another distinct packaging operation.

Although, as discussed above, FIG. 1 illustrates a 12 pack configuration, the present invention will satisfactorily perform with respect to any multi-row configurations, within the practical limits of a packaging machine's ability to package or insert the multiple rows into a carton. For example, if the present invention were applied to insert a partition between articles arranged in a six pack configuration, the third article row and fourth article row of the first embodiment could be eliminated, and side rail 12 would be adjacent the second article row, as shown in FIG. 1B. In this embodiment, conveyor 114 moves articles A downstream, between side rails 112 and 113 and spaced selector flights 115. The article group consists of six articles arranged in two rows 122 and 123, although alternatively the articles could be arranged in three rows and two columns, which configuration would require a second divider. As conveyor 114 moves the six pack configured article group downstream, the tapered end portion 116 of divider 111 begins to extend between article rows 122 and 123. At this approximate position, side rail 112 includes angled portion 121 which deviates outwardly a distance $d_4$, allowing article row 123 to be moved transversely, away from article row 122 identically as discussed above with respect to the prior embodiment. In this embodiment, however, no further article rows are present. The continued movement of conveyor 114 fully divides article rows 122 and 123 into article subgroups $SG_7$ and $SG_8$, which are transversely separated from one another a distance equal to the width of divider 111. The structure and function of divider 111 is identical to that of divider 11. Further, the width of divider 111 is determined identically as the determination of the width of divider 11, as discussed above. At position 131, partition $P_3$ is inserted between article subgroups $SG_7$ and $SG_8$. Downstream of this position, side rail 112 angles inwardly, toward side rail 113, a transverse distance which is also equal to distance $d_4$. As the article subgroups are continuously moved downstream, the articles in subgroup $SG_8$ contact angle side rail portion 170, and are moved transversely toward subgroup S and side rail 113. This camming of the articles in article row 123 effectively recombines the articles in row 123 with the articles in row 122. The articles are thereby placed in contact with partition $P_3$, so that the partition is held in place between the articles in the recombined article group. Therefore, in this embodiment in which a six pack configuration of two rows and three columns is divided and recombined, the recombining of the article subgroups can be accomplished by angling of either side rail 112 or side rail 113, as desired, rather than by using a second divider.

As discussed above, the present invention functions satisfactorily with any article group comprised of two or more longitudinal rows of articles. In any configuration, the last row or subgroup of articles to be recombined to form the configuration of the initial article group can be moved by an inward angling of the adjacent side rail of the partition insertion assembly.

While the principal objective of the present invention is to separate rows of articles with an immovable divider disposed within the article group's longitudinal path of travel, to insert a partition, and to recombine the article groups again using a stationary cam, the present invention is not limited to separating and combining the rows of articles in the orders described above. These orders are used for illustrative purposes only, and it is contemplated that the orders of separation and recombining may be changed without departing from the scope of the present invention.

Figure 5:
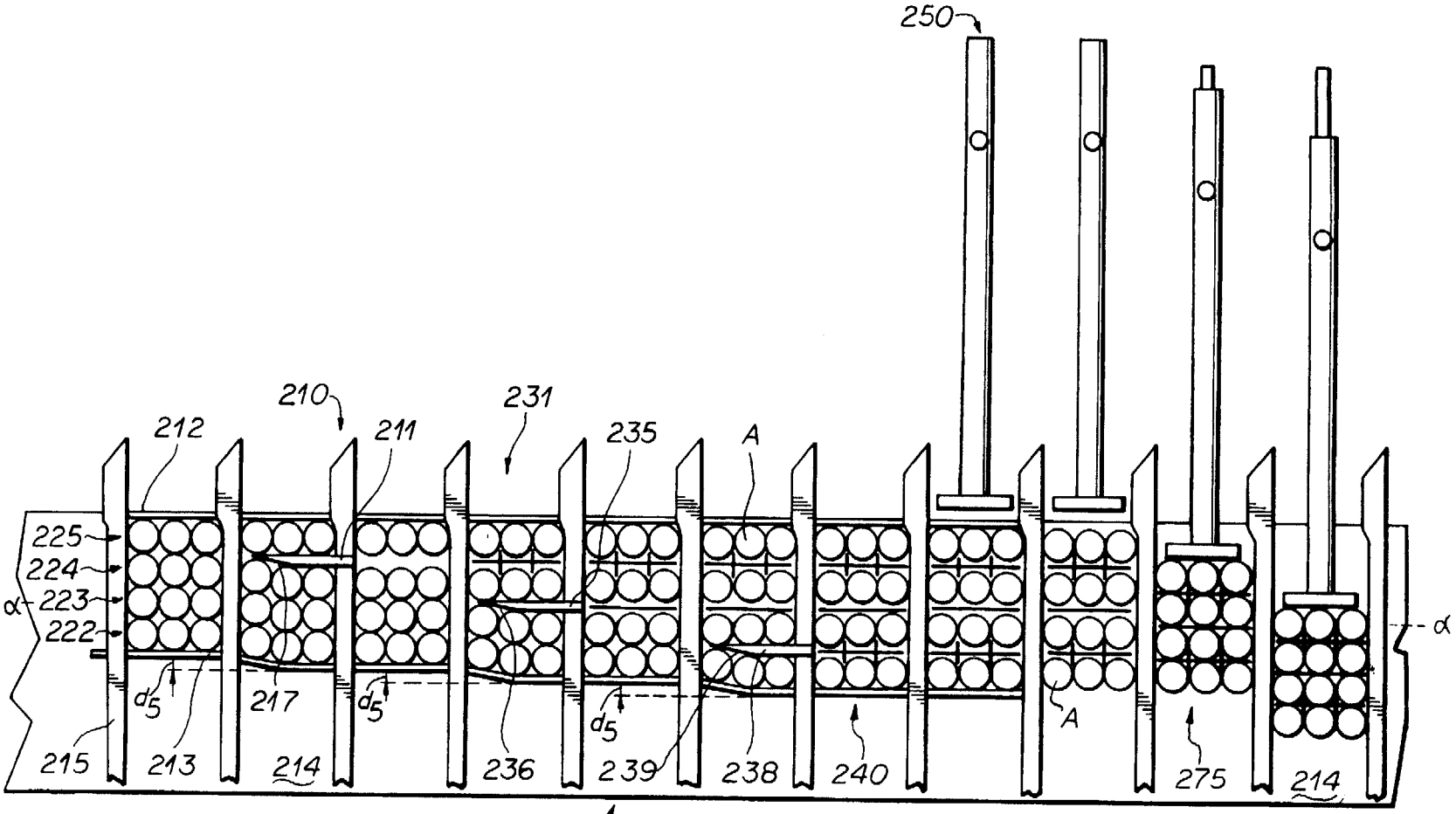
FIG. 5 is a fragmentary, schematic plan view of yet another embodiment of the present invention.

FIG. 5 illustrates yet another embodiment of the present invention, employing the same principals as those discussed above, but in a different order. In FIG. 5, a packaging machine having a partition insertion assembly 210 includes a conveyor 214 with side rails 212 and 213, respectively. In this embodiment, however, side rail 212 is entirely parallel to the longitudinal axis of conveyor 214 once the preconfigured article groups are formed. Article dividers 211,235 and 238 are sequentially disposed in the longitudinal path of travel of the articles groups, and serve to sequentially divide the article rows 222, 223, 224, 225 from one another. These article dividers are identical to each other in structure and function, and are identical in structure to divider 38. The effect of the camming action of these dividers against the rows of articles is identical in this embodiment as with the first embodiment previously described, except that the angled edge portion 217 of divider 211 is on the side edge of divider 211 adjacent to side rail 213. Angled edges 236 and 239 also are adjacent side rail 213, as shown in FIG. 5. Further, at each position at which the respective angled edges 217, 236 and 239 of dividers 211, 235 and 238, respectively, angle toward side rail 213 to divide successive rows of articles from one another, side rail 213 also angles away from the side rail 212 a distance $d_5$, which is substantially equal to the width W of dividers 211, 235, and 238, respectively. Side rail 213, therefore, angles away from side rail 212 a total distance equal to 3 times $d_5$.

It should be readily apparent from the prior description that the three outward deviations of the side rail 213, corresponding with the angling of the angled portions of the dividers, increases the working conveyor width and provides room for the successive rows of articles to be separated from one another, in order to allow partitions to be inserted therebetween at positions 231, 237, and 240, respectively. Another difference in this third embodiment, however, is that the articles in the respective article rows are not recombined until after the last partition has been inserted, and the articles have reached position 275. At position 275, the articles are not only recombined, but are transferred off of the conveyor and into a carton or carrier (not shown) by, for example, an article group lateral transfer mechanism 250. Alternatively, side rail 212 can be angled downwardly across each article row toward side rail 213 to effectively act as a camming member, pushing the article rows 222,223, 224 and 225 back together, and recombining the article group and direct the entire group into a carton. This would eliminate the need for a separate article transfer mechanism, such as mechanism 250.

As referenced above, many different variations may be had in the separating and recombining of articles, the above-referenced embodiments being disclosed for illustrative purposes only. For example, from the above disclosure, it should be readily apparent that the position of the angled surfaces of the dividers and the corresponding angled sections of the side rail may be changed to divide or recombine the article groups and subgroups in different orders. The order in which article subgroups are divided and recombined is not critical to the operability of the present invention, provided that adjacent article rows are separated a sufficient extent and for a sufficient time to allow a partition to be inserted therebetween in the continuous, high speed packaging operation.

The various embodiments of accomplishing the objects of the present invention can be altered, depending upon the circumstances of the packaging machine. For example, the embodiment first disclosed herein would require less manufacturing space than would the third embodiment. If the manufacturing space limitations are a consideration, then an embodiment simultaneously separating and recombining rows of articles and article groups may be most appropriate. Additionally, the present invention obviously can be adapted to divide and recombine article groups of practically any configuration, as long as the group consists of at least two rows of articles, within the practical packaging machine limitations. These and many other additions and modifications might well be made to the embodiments illustrated herein without departing from the spirit and scope of the invention as set forth in the claims.

Wherefore, the following is claimed:

1. A method for inserting partitions into a group of articles, comprising the steps of:

(a) combining articles with article selectors to form an article group of predetermined configuration, including rows of articles;

(b) conveying said article group and in a direction along a path of travel;

(c) creating with a first divider disposed above said article selectors a first article subgroup and a second article subgroup by separating at least one row of articles from said article group;

(d) inserting a first partition between said first article subgroup and said second article subgroup; and (e) recombining said first article subgroup with at least a portion of said second article subgroup.

2. The method of claim 1, further comprising the steps of:

(f) creating a third article subgroup and a fourth article subgroup by separating with a second divider disposed above said article selectors at least one row of articles from said second article subgroup;

(g) inserting a second partition between said third article subgroup and said fourth article subgroup; and (h) recombining said third article subgroup with at least a portion of said fourth article subgroup.

3. The method of claim 2, further comprising the steps of:

(i) creating a fifth article subgroup and a sixth article subgroup by separating with a third divider disposed above said article selectors at least one row of articles from said fourth article subgroup;

(j) inserting a third partition between said fifth article subgroup and said sixth article subgroup; and (k) recombining said fifth article subgroup with at least a portion of said sixth article subgroup.

4. The method of claim 1, wherein step (c) further comprises the step of disposing along said path of travel said first divider for moving said articles so that a portion of said articles within said article group contacts said first divider for moving said articles, and said articles of said second article subgroup are thereby moved substantially laterally with respect to said path of travel and away from said articles in said first article subgroup.

5. The method of claim 2, wherein step (f) further comprises the step of disposing along said path of travel said second divider for moving said articles so that a portion of said articles within said second article subgroup contacts said second divider for moving said articles, and at least a portion of said articles of said second article subgroup are thereby moved substantially laterally with respect to said path of travel and toward said articles in said first article subgroup.

6. The method of claim 3, wherein step (i) further comprises the step of disposing along said path of travel said third divider for moving said articles so that a portion of said articles within said fourth article subgroup contacts said third divider for moving said articles, and at least a portion of said articles of said fourth article subgroup are thereby moved substantially laterally with respect to said path of travel and toward said articles in said third article subgroup.

7. The method of claim 4, wherein said step of creating includes the step of forming said first divider with a camming surface.

8. The method of claim 4, wherein said step of creating includes the step of forming said first divider to have at least one tapered end to form a substantially wedge-shaped end portion.

9. The method of claim 8, wherein said step of creating includes the step of forming said first divider to be elongate with said tapered end extending in an opposite direction from the direction in which said article group is being conveyed.

10. The method of claim 1, wherein said step of conveying comprises the step of with said article group with a conveyor having an elongate, moving bedplate with said article selectors for defining article groups spaced along said conveyor.

11. The method of claim 10, wherein said step of conveying comprises the steps of attaching said article selectors to said bedplate and placing said article selectors transversely to said path of travel.

12. The method of claim 11, wherein said step of conveying comprises the step of forming said article selectors to be tapered at least at one end to form a wedge-shaped end portion.

13. The method of claim 1, wherein said step of inserting comprises the step of forcibly directing said partition downwardly from above said article group.

14. The method of claim 1, wherein step (e) further comprises the step of disposing along said path of travel a cam so that said articles of said second article subgroup will contact said cam and be moved substantially laterally with respect to said path of travel and toward said articles in said first article subgroup.

15. The method of claim 14, wherein said step of disposing comprises the step of forming said cam with a side rail.

16. The method of claim 1, wherein said step of creating said first article subgroup and said second article subgroup comprise the step of adjusting a position of said lane divider so that said lane divider is between said first article subgroup and said second article subgroup.

17. A method for inserting a partition having an elongate body and a substantially transversely extending side panel into a group of articles, each of said articles in said group having outer edges, comprising the steps of:

(a) combining articles into an article group comprising rows of articles;

(b) conveying said article group along a longitudinal path of travel using a conveyor having a moveable bedplate (c) creating first and second article subgroups by separating a first article subgroup comprising at least one row of articles from said article group by moving the articles within said first article subgroup a predetermined distance transversely across said bedplate;

(d) inserting a first partition between said first article subgroup and said second article subgroup by directing said first partition downwardly from above said article group; and (e) recombining said first article subgroup with said second article subgroup so that said side panel and said elongate body of said first partition are between the outer edges of adjacent articles in said group.

18. The method of claim 16, wherein said step of recombining comprises the step of moving said second article subgroup toward said first article subgroup.

19. The method of claim 17, wherein said step of recombining comprises the step of moving said first article subgroup toward said second article subgroup.

20. The method of claim 17, wherein said step of combining articles comprises the step of forming said article group between article selectors and said step of creating said first and second article subgroups comprises the step of placing a lane divider above said article selectors.

21. The method of claim 20, wherein said step of creating said first and second article subgroups comprises the step of adjusting a position of said lane divider to be between said first and second article subgroups.

22. An apparatus for inserting partitions between articles arranged into an article group including rows of articles, comprising:

(a) means for conveying said article group along a path of travel from an upstream position to a downstream position;

(b) means disposed along said path of travel for creating a first article subgroup and a second article subgroup, by separating the first article subgroup comprising at least one row of articles from said second article subgroup;

(c) means for inserting a partition between said first article subgroup and said second article subgroup, said inserting means being disposed above said means for conveying said article group; and (d) means disposed along said path of travel, for recombining said first article subgroup with said second article subgroup;

wherein said inserting means places said partition between adjacent articles in said first article subgroup and between adjacent articles in said second article subgroup.

23. The apparatus of claim 22, said means for creating a first article subgroup and a second article subgroup comprising a divider having an elongate body and a tapered end portion, said divider being aligned so that said tapered end portion is directed toward said upstream position.

24. The apparatus of claim 22, said means for recombining comprising a rail having an angled portion.

25. The apparatus of claim 22, wherein said conveying means comprises selector wedges for forming said article group and said creating means comprises a divider disposed above said selector wedges.

26. The apparatus of claim 25, further comprising means for adjusting a position of said divider relative to said articles group.

27. An apparatus for inserting partitions within a group of articles, comprising:

means for conveying said group of articles in a downstream direction;

a pair of side rails generally parallel to said downstream direction for guiding said group of articles between said side rails in said downstream direction;

a pair of article selectors disposed across said conveying means for forming said group of articles between said article selectors;

at least one divider located between said pair of side rails and parallel to said downstream direction for forming a first article subgroup on one side of said one divider and a second article subgroup on an opposite side of said one divider, said one divider being mounted above said conveying means and above said article selectors; and means, located downstream from said one divider, for inserting a partition between said first article subgroup and said second article subgroup.

28. The apparatus of claim 27, wherein said partition has a main body for separating articles in said first subgroup from articles in said second subgroup and a transverse wall for separating adjacent articles in said first article subgroup and also for separating adjacent articles in said second article subgroup.

29. The apparatus of claim 27, wherein a position of said divider is adjustable relative to said group of articles.

* * * * *

UNITED STATES PATENT AND TRADEMARK OFFICE

CERTIFICATE OF CORRECTION

PATENT NO. : 5,485,713
DATED : January 23, 1996
INVENTOR(S) : Frank Moncrief

It is certified that error appears in the above-identified patent and that said Letters Patent is hereby corrected as shown below:

Column 12,
Line 1, after "and" insert -- article selectors --.
Line 67, delete the first occurrence of "with" and insert -- conveying --.

Column 14,
Line 4, after "means" insert a comma and after "travel" insert a comma.

Signed and Sealed this

Twenty-sixth Day of July, 2005

JON W. DUDAS
*Director of the United States Patent and Trademark Office*